US007083363B2

(12) United States Patent
Baker

(10) Patent No.: US 7,083,363 B2
(45) Date of Patent: Aug. 1, 2006

(54) PIER INSTALLATION SYSTEM AND METHOD

(76) Inventor: Jim Nelson Baker, 9608 FM 707, Hawley, TX (US) 79525-2412

( * ) Notice: Subject to any disclaimer, the term of this patent is extended or adjusted under 35 U.S.C. 154(b) by 237 days.

(21) Appl. No.: 10/444,037

(22) Filed: May 22, 2003

(65) Prior Publication Data

US 2004/0244313 A1 Dec. 9, 2004

(51) Int. Cl.
*E02D 11/00* (2006.01)
*E02D 13/00* (2006.01)

(52) U.S. Cl. ..... 405/232; 405/244; 52/169.9

(58) Field of Classification Search ..... 405/230, 405/232, 244, 249; 52/169.2, 169.9
See application file for complete search history.

(56) References Cited

U.S. PATENT DOCUMENTS

| | | | | |
|---|---|---|---|---|
| 5,660,504 | A * | 8/1997 | Reinert, Sr. | 405/244 |
| 5,944,452 | A * | 8/1999 | Reinert, Sr. | 405/232 |
| 6,234,719 | B1 * | 5/2001 | Roynestad | 405/244 |
| 6,536,541 | B1 * | 3/2003 | Pedrelli | 175/135 |
| 6,641,332 | B1 * | 11/2003 | Alvarado | 405/232 |
| 2003/0049079 | A1 * | 3/2003 | Bartlett et al. | 405/232 |

* cited by examiner

*Primary Examiner*—Jong-Suk (James) Lee

(57) ABSTRACT

A device for repairing the foundation of a building comprising a base frame being defined by a front end and a rear end. The front end and rear end are supported by wheels. A plate member is transversely mounted upon the base frame proximately near the rear end. A crane assembly is supported by the plate member. The crane assembly further comprises a three hundred sixty degree swivel joint mounted upon the plate member, a vertically extending shaft being swivelly connected to the swivel joint, a horizontally extending arm being mounted on the top of the shaft, and a lifting mechanism connected to the arm such that the arm can be lowered and raised. A fifth wheel assembly is situated underneath the base frame and is pivotally connected to the wheels supporting the rear end. A steering mechanism is connected to the fifth wheel assembly for maneuvering the direction of the rear wheels. A drive stand is swivelly connected to the arm at its far end. The drive stand is adapted to contain a foundation pier assembly. The present invention further comprises a means for driving the foundation pier assembly underneath the foundation to a point of resistance and a means for lifting the installed foundation assembly such that foundation can be elevated to a particular height. At least one stabilizer is removably attached to a corner of the base frame such that the weight of the base frame can be stabilized during the pier pressing process.

29 Claims, 7 Drawing Sheets

PIER INSTALLATION SYSTEM AND METHOD

BACKGROUND

A building is constructed from several elements. One of those elements is the foundation which supports the building and provides stability. The structural design of the building depends greatly on the nature of the soil and the underlying geologic conditions and modifications made by man.

The most common types of foundation systems are classified as shallow and deep. Shallow foundation systems are several feet below the bottom of the building; examples are spread footings and mats. Deep foundation systems extend several dozen feet below the building.

The most economical foundation is reinforced-concrete spread footing, which is used for buildings in areas where the subsurface conditions present no unusual difficulties. The foundation consists of concrete slabs located under each structural column and a continuous slab under load bearing walls. Mat foundations are typically used when the building load are so extensive and the soil so week that individual footings would cover more than half the building area. A mat is a flat concrete slab, heavily reinforced with steel, which carries the downward loads of the individual columns or walls.

Many houses are constructed with foundations that are inadequate for the soil conditions existing on the site. Because of the lack of suitable land, homes are often build on marginal and land that has insufficient bearing capacity to support the substantial weight of a structure.

The major reasons for foundation failure are:

1. Soils with high clay contents will swell and shrink as moisture increases or decreases.
2. Soils that were not properly prepared cannot bear the load and will consolidate and compact under the weight of the foundation.
3. Slope and natural drainage can cause soils to wash away or erode under the foundation structure.

The present invention is utilized to economically repair shallow foundation systems. The unique system allows the installation of piers in virtually any situation with minimal excavation and less man hours that is currently utilized with existing systems.

SUMMARY

This invention relates to a device and method of repairing a sunken foundation of a building. The device consists of a buggy having a crane assembly mounted thereon. A drive stand is swivelly connected to the horizontal arm of the crane assembly. The drive stand is adapted to contain a foundation pier assembly to be driven underground to support the sunken foundation. Operatively mounted upon the upper end of the drive stand is a removable drive cylinder, which is operatively connected to a hydraulic power source for driving the foundation pier assembly underground. The device further includes a lifting mechanism to elevate each driven foundation pier assembly, which elevates the sunken foundation.

DRAWINGS

The details of the present invention are described in connection with the accompany drawings in which.

DETAILED SPECIFICATION

The foundation installation repair device of the present invention is described in two modes, an operational mode and a storage mode. In its operational mode the device is utilized to install foundation pier assembly underneath the foundation of a building and to lift the foundation to a particular elevation. When the device is in non-operational mode, several elements of the device retracts to allow easy storage.

Figure 1:
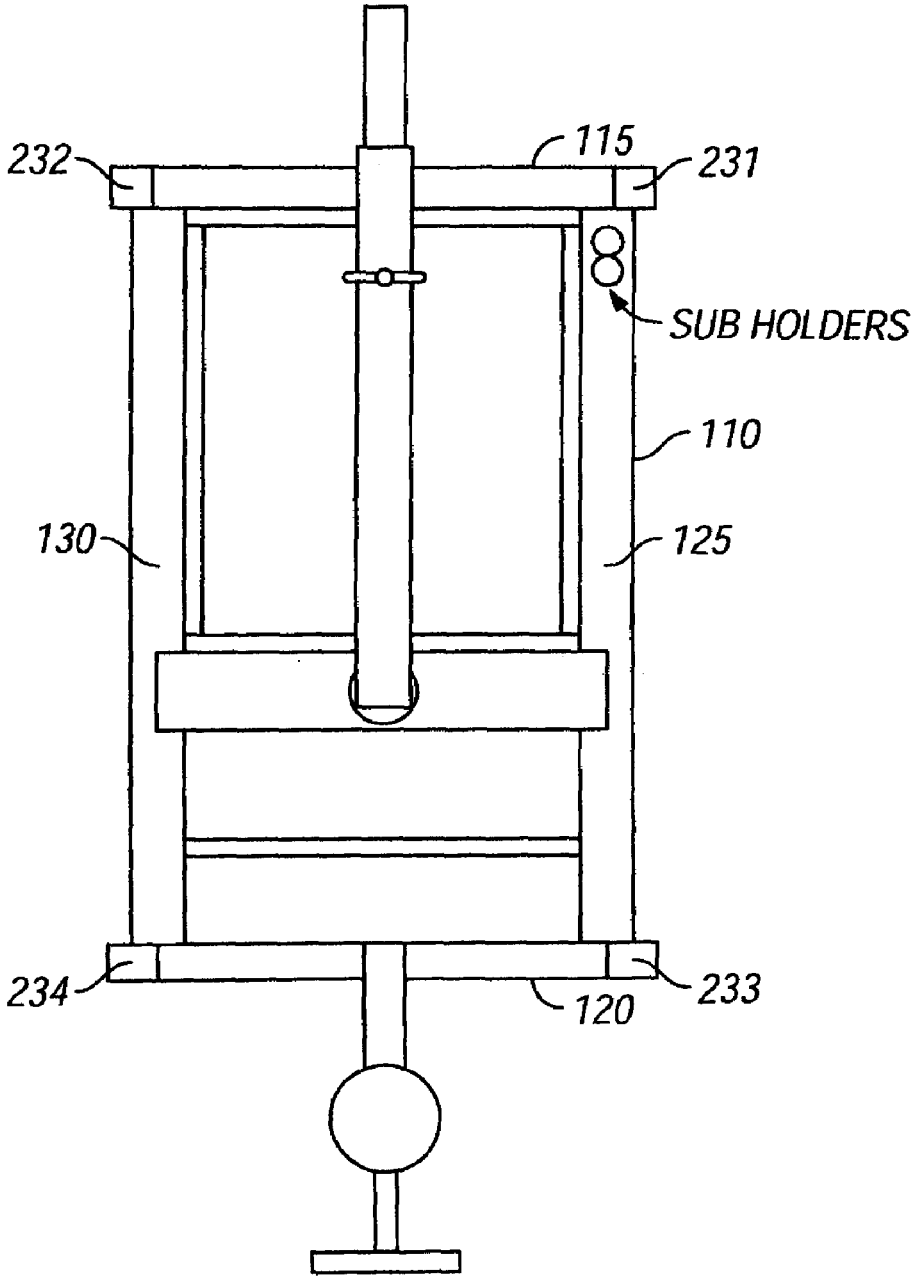
FIG. 1 is a top plan view of the overall invention shown in an operational configuration, a foundation buggy device.

Referring to FIG. 1 there is shown a top plan view of the present invention in its operational mode. The present invention includes a buggy device having a base frame with a steering mechanism, a crane assembly, a drive stand, a driving mechanism, lifting mechanism, foundation pier assembly and an outrigger stabilizer means.

In the present invention, the pier assembly is driven underground to support the lifted foundation. The pier assembly includes a foundation shoe, stacked pier sections, and a pier cap. The foundation shoe is placed underneath the grade beam of the foundation, the pier sections slidably engage the foundation shoe and are stacked upon each other in the foundation shoe, and the pier cap secures the pressed pier sections to the foundation shoe upon the completion of the pier pressing process.

In the present invention, the several tools are used to assist in driving the pier assembly underground. These tools includes a drive head and a drive sub. The drive head sits upon the top of the pier section to be pressed underground. The drive sub is placed upon the pier section to assist in driving the pier section under ground. Unlike the pier assembly, which remains underground to assist in supporting the lifted foundation, the drive head and drive sub are removed after performing their specific functions.

As shown in the embodiment illustrated in FIG. 1, base frame (110) is a polygonal shape planar platform. In the specific illustrated embodiment, the base frame (110) has a rectangular shape and is made of a rigid metallic material such as steel or another compatible material. Base frame (110) is further defined by a front end (115) and a rear end (120). Each side edge (125, 130) is respectively re-enforced with a support beam. The front end (115) and the rear end (120) are re-enforced with a hollow support beam having an internal cavity at each respective corner (231, 232, 233, 234). Each support beam can be made of gauge tubing or another such compatible material.

The base frame (110) is constructed to form a tray to hold construction equipment during use. The front end (115) and the rear end (120) are respectively supported by wheel means (116, 121). In the specific illustrated embodiment, the wheel means (116, 121) are large pneumatic tires and retained by conventional axles.

Figure 2:
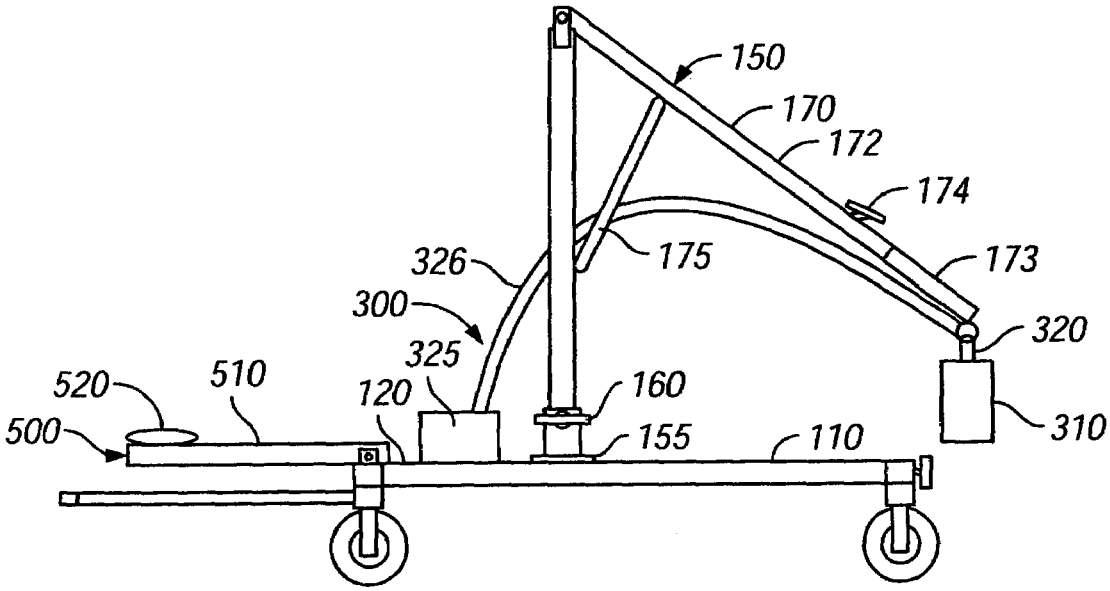
FIG. 2 is a side view of the overall invention.

Referring to FIG. 2, there is shown a side perspective view of the device. The device further comprises a crane assembly (150) being supported by a plate member (155). Plate member (155) is transversely mounted upon the base frame (110) proximately near its mid-section. In the illustrated embodiment, plate member (155) is rectangular in shape dimensioned to extend across the base frame (110). Each side edge of plate member (155) is mounted upon its corresponding base frame (110) side edge (125, 130). Mounted upon plate member (155) is swivel joint (160) which provides the capability of turning the crane assembly (150) three hundred sixty degrees. Crane assembly (150) further comprises a vertically extending shaft (165) connected to the swivel joint (160). Mounted upon the top of the shaft (165) is a horizontally extending arm (170). Operably connected to the arm (170) is a first lifting mechanism (175) for lowering and raising the arm (170). As illustrated in the embodiment shown in FIG. 1, the lifting mechanism (175) can be a manual or electric hydraulic jack or another such comparable mechanism. The arm (170) further comprises a first portion (172) being telescoped within a second portion (173). To vary the length of arm (170) second portion (173) is extended and locking mechanism (174) secures the arm to the set length. In the illustrated embodiment, locking mechanism (174) further comprises a plurality of apertures along the horizontal axis of portion (172, 173) of the arm and a locking bolt. To vary the length of the crane assembly, the second portion is extended inwardly or outwardly to a predetermined position such that the first portion (172) aligns with an aperture of the second portion (173). Then, the bolt is inserted through both of the apertures securing the arm (170) of the crane assembly (150) to a particular length.

Figure 3:
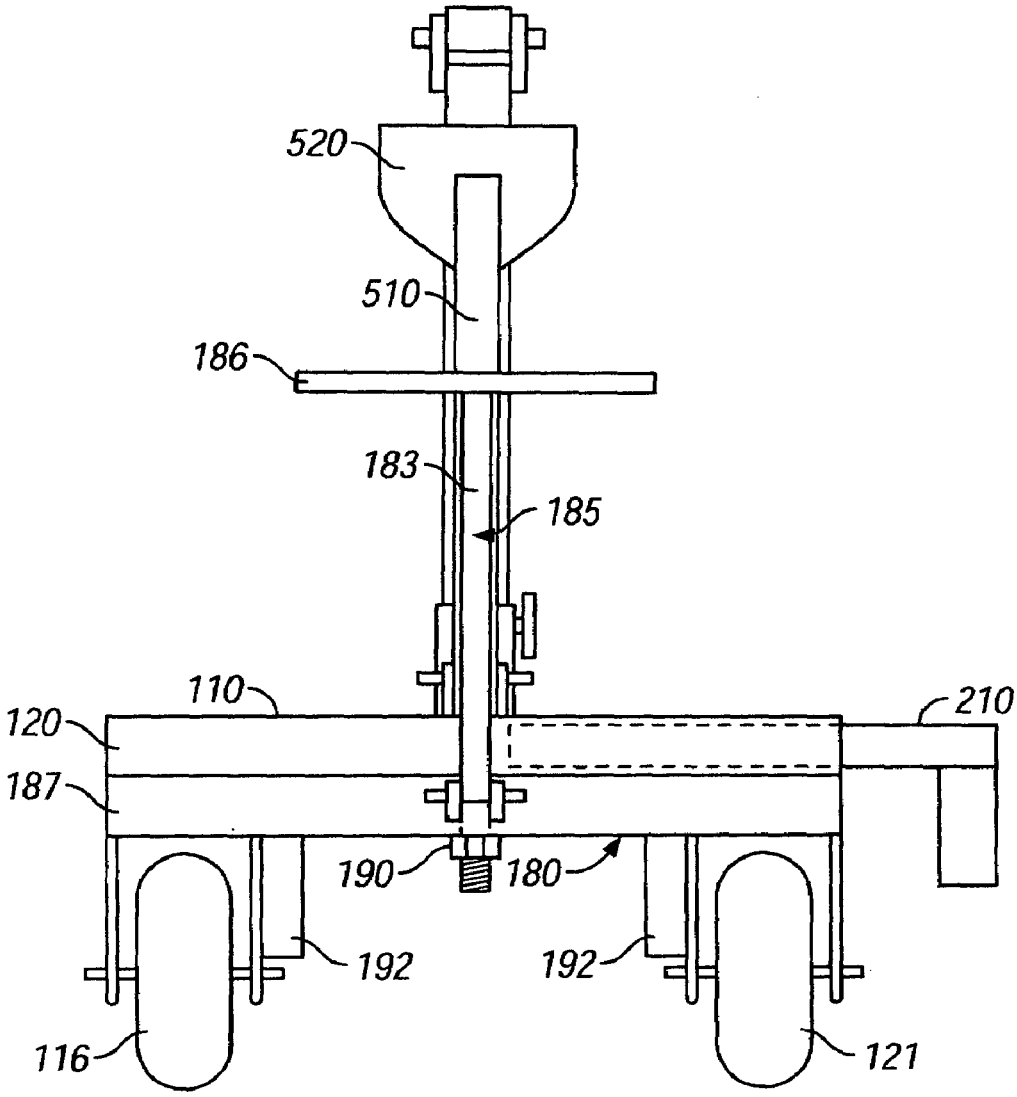
FIG. 3 is a rear view of the invention with the seat in a non-operational position.

Referring to FIG. 3, there is shown a rear view of the device. In the illustrated embodiment, the device further includes a fifth wheel assembly (180) being swivelly connected to the underside of the rear end (120) of the base frame (110). As shown, the fifth wheel assembly (180) further includes a steering rod (187) that extends the width of the rear end (120). At its center point, steering rod (187) is swivelly connected to underside of base frame (120) utilizing a swivel joint means (190). Each end of steering rod (187) is coupled to a rear wheel means (121) utilizing a brace (192).

A steering mechanism (185) provides the capability of maneuvering the direction of the rear wheel means (121). As shown, the steering mechanism (185) further includes a shaft (183) that is connected to the steering rod (187). A handle (186) is securely attached to the opposite end of shaft (183). The steering mechanism (185) provides manual steering for the entire apparatus through the rear wheels (121). By swiveling the steering rod (187) with handle (186) to a desired position, the device can be effectively maneuvered. Steering rod (187) can be swiveled at least 90 degrees in either direction.

The embodiment illustrated in FIG. 3 further comprises at least one outrigger (210) for stabilizing the weight of the base frame (110) during the process of pressing foundation piers underneath the foundation of a building. Each outrigger (210) can be removably attached to a respective corner of the base frame (110) as shown in FIG. 3. Outrigger (210) further comprises an L shaped beam (220).

Figure 4:
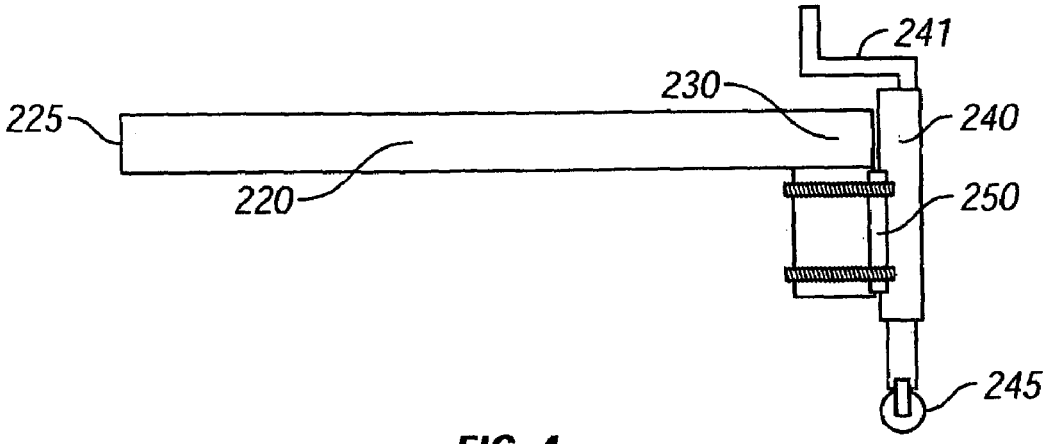
FIG. 4 is a side view of the outrigger stabilizer.

As shown in FIG. 4, the L shape beam (220) further comprises a first horizontal beam (225) perpendicular attached to a vertical arm (230) that extends linearly downward. At one end the horizontal beam (225) is adapted to slide into each respective internal cavity located at each corner of the base frame. The vertical arm (230) is securely fastened to a leg member (240) supported by at least one second wheel means (245). In the illustrated embodiment, the vertical arm (230) is secured to leg member (240) by a conventional bracket or another such compatible securing means. In the specific illustrated embodiment, each leg member (240) is supported by a small conventional wheel.

In order to stabilize the device and lock it in place, a manual crankshaft (241) is mounted upon leg member (240). The crankshaft (241) is manually turned until the wheel attached to leg member (240) locks in place to the ground surface preventing the device from moving. A second outrigger can be attached as described above to the opposite end of the base frame. The attachment of two outriggers can provide enough stabilization to support the weight mounted upon the device during the pier pressing process and to prevent the device from overturning during the installation of the foundation piers.

Referring to the embodiment illustrated in FIG. 2, driving mechanism (300) further includes a removable drive cylinder (320) being mounted at the upper end of the drive stand (310). The driving mechanism (300) further comprises a detachable generator (325) that is operatively connected to the removable drive cylinder (320). The generator (325) can be a 10,000-PSI hydraulic power source that can be connected to the cylinder (320) via hydraulic hoses (326). The generator (325) provides a sustained amount of hydraulic force to drive a foundation pier assembly underneath ground level. In the illustrated embodiment, the driving mechanism (300) can produce 25 tons of sustained hydraulic pressure.

Figure 4A:
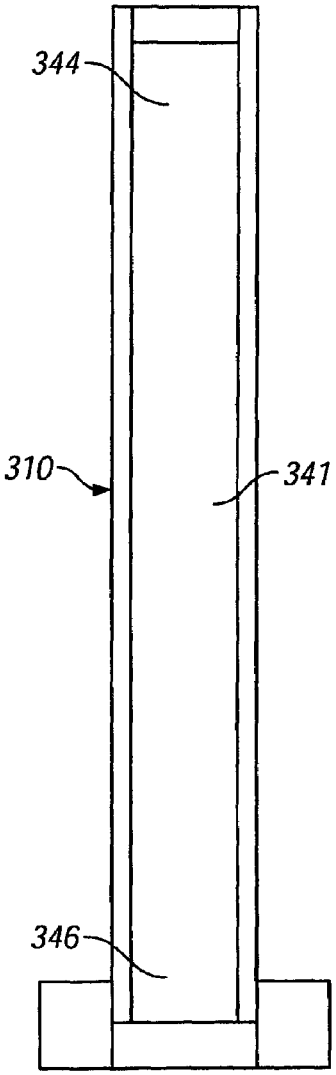
FIG. 4A is a front view of the drive stand.
Figure 4B:
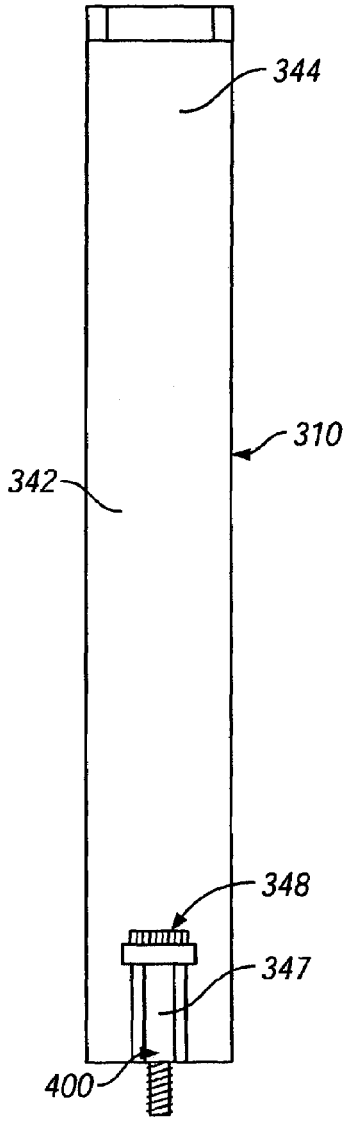
FIG. 4B is a back view of the drive stand.
Figure 4C:
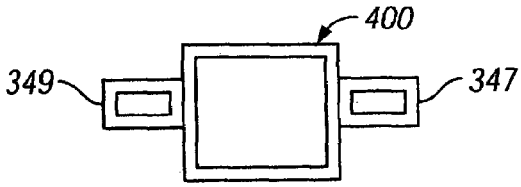

Referring to FIGS. 4A and 4B, there is shown an exploded front and rear view of drive stand (310). Drive stand (310) further includes a rectangular housing being tapered at its distal end (346). The housing further comprises a front section (341) and a rear section (342). The front section (341) of housing is opened from its upper end (344) to its lower end (346). The drive cylinder mounts upon the upper end (344) and the foundation shoe (described below) is mounted within the lower end (346) of the drive stand (310). Integrated into the bottom end of the housing is sleeve retaining plate member (400). The foundation shoe is bolted to sleeve retaining plate member (400). Referring to FIG. 4C, there is shown a cross-sectional view of sleeve retaining plate member (400). As shown in FIG. 4C, sleeve plate retaining member (400) further includes a larger aperture sandwiched between two smaller apertures. The sleeve plate retaining member is adapted to aligned over the multi-compartment sleeve of the foundation shoe (described below) wherein each smaller aperture (349, 347) aligns over each smaller sleeve of the foundation shoe such the foundation shoe can be bolted to the drive stand through each smaller aperture. During the pier pressing process, bolt (348) secures the foundation shoe in place through each smaller aperture (347, 349).

As shown in FIG. 2, the device further includes a seat assembly (500). The seat assembly further includes a horizontal support member (510) pivotally coupled to the top-side of the rear side (120) of base frame (110) at one end. At the opposite end of horizontal support member (510), seat member (520) is swivelly connected. The swivel connection of seat member (520) provides the operator the capability of moving in multiple directions during the pier assembly pressing process. Additionally, horizontal support member (510) can be pivoted upward during non-operation of the device as shown in FIG. 3.

Figure 5A:
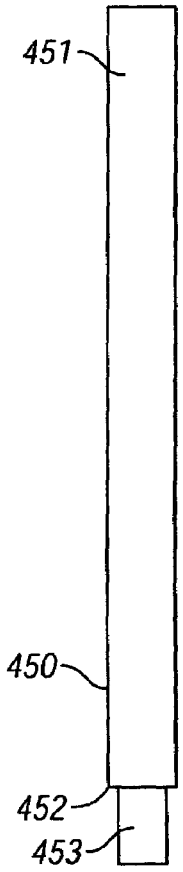
FIG. 5A is a side view of a pier section.
Figure 6:
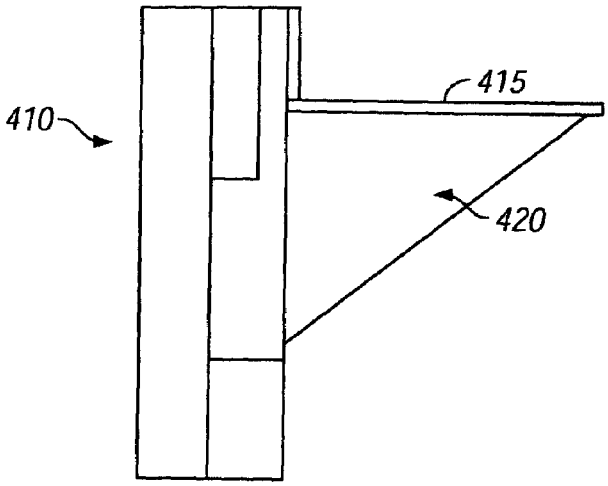
FIG. 6 is a side view of the foundation shoe.
Figure 6A:
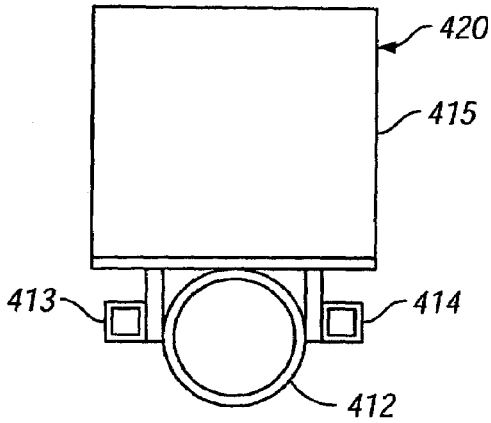
FIG. 6A is a top view of the foundation shoe.
Figure 6B:
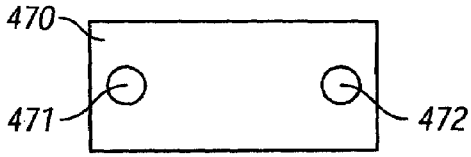
FIG. 6B is a top view of a pier cap.
Figure 7:
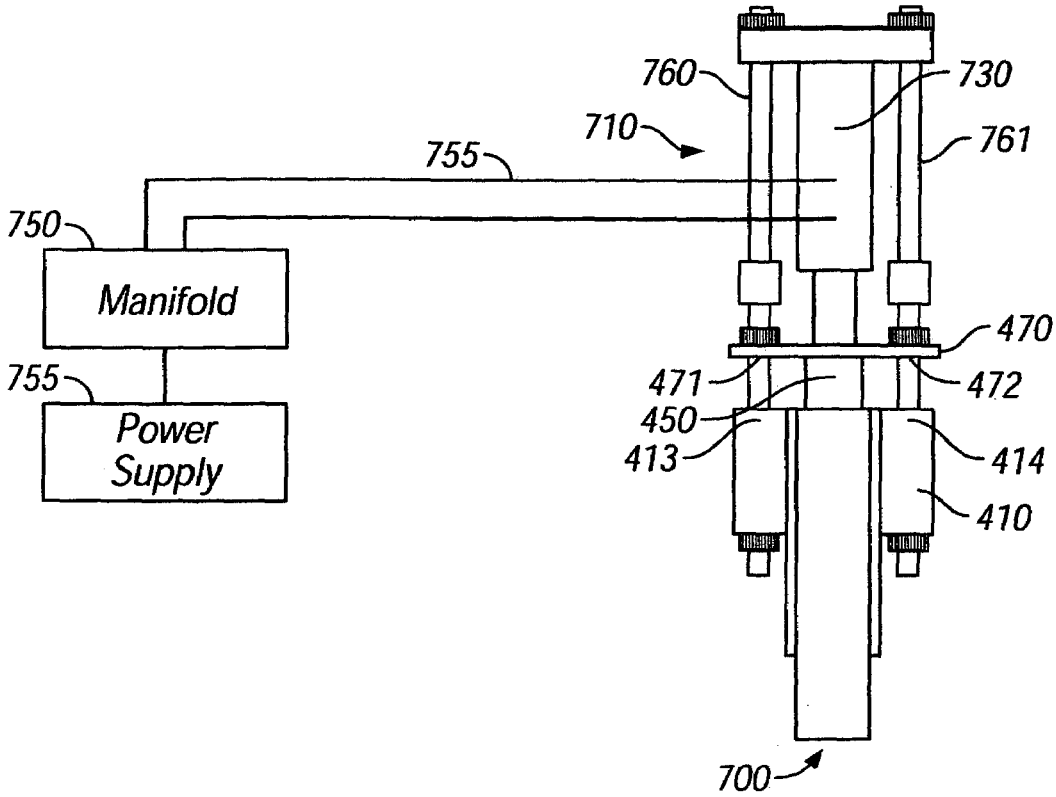
FIG. 7 is a side view of the lifting mechanism.
Figure 8:
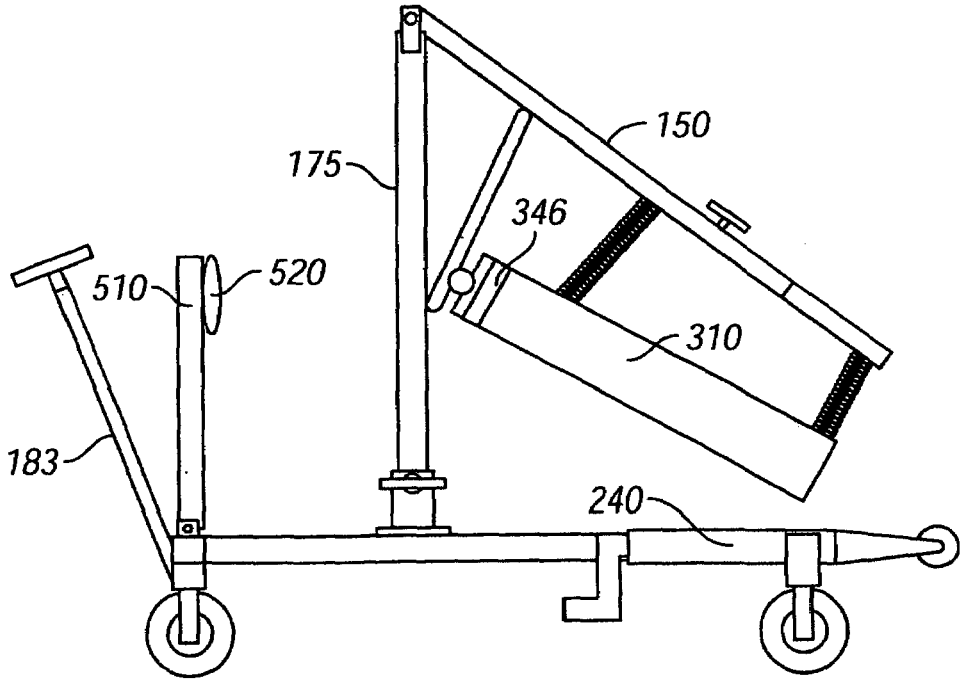
FIG. 8 is a side perspective view of the Buggy Device of the present invention while in a non-operational mode.

Referring to FIGS. 5A and 6–6B there is shown exploded views of the pier assembly driven into the ground to support the foundation of the building. As shown in FIG. 7, the pier assembly includes the foundation shoe (410) slidably engaged with a pier section (450) that is securely held in place by pier cap (470).

Referring to FIG. 6, there is shown an exploded side view of foundation shoe (410). In operation, the foundation shoe (410) is bolted to the lower end of the drive stand as shown in FIGS. 4B and 4C. As shown in FIG. 6A, the foundation shoe (410) is further defined by a multi-compartment sleeve with a triangular flange (420) integrated with its upper end. The multi-compartment sleeve further comprises a larger circular shape sleeve (412) sandwiched between two smaller sleeves (413, 414). The circular shape sleeve (412) is adapted with a diameter to slidably engage the pier section described below. The foundation shoe (410) is placed under the grade beam such that the horizontal plane (415) of the triangular flange (420) is securely mounted underneath the foundation of the building.

As shown in FIG. 5A, the pier assembly further includes at least one stackable pier section (450). Pier section (450) is further defined by a hollow elongated cylindrical pipe member having a top end (451) and a bottom end (452). The pipe member can be made of steel or another such compatible material. The bottom end (452) of pier section (450) slidably engaged the interior circular sleeve (412) of the foundation shoe describe above. The bottom end (452) pier section is adapted with a short cylindrical receiver (453) having a slightly smaller circumference than the bottom end (452). Receiver (453) has a slightly smaller circumference to stack upon the top end (451) of another pier section. In this embodiment of the present invention, multiple pier sections are stacked and driven under ground until a point of resistance is reached.

As shown in FIG. 6B, the pier assembly further includes a pier cap (470). After the process of driving pier sections under ground is complete, pier cap (470) is securely fastened to the foundation shoe such that the driven pier section can be held in place to support the foundation. In the illustrated embodiment, pier cap has a rectangular shape with two orifices (471, 472) at each opposite end. In operation, as shown in FIG. 7, the pier cap (470) overlays the pressed pier section with orifices (471, 472) aligned over the smaller sleeves (413, 414) of the multi-compartment sleeve of the foundation shoe. Then, the pier cap (470) is bolted to the foundation shoe through the orifices (471, 472) utilizing long all threaded studs (760,761), which extend from each orifice (471, 472) through each smaller sleeve (413, 414) of the foundation shoe. Then, each all threaded stud (760,761) is bolted at its upper end above each orifice (471, 472) and each all threaded (760,761) is bolted at its lower end below each smaller foundation shoe sleeve (413,414). After the pier pressing process is complete, the foundation shoe is unbolted from the drive stand and the pier cap is bolted to the foundation shoe to securely hold the pressed pier sections in place.

Figure 5B:
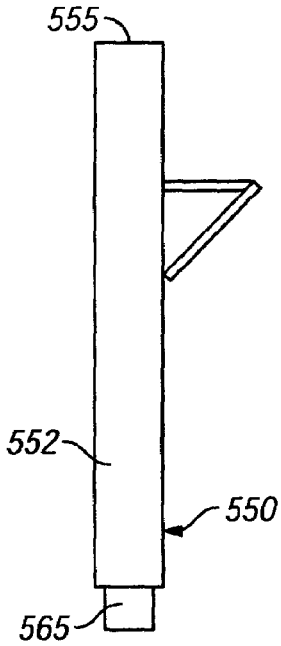
FIGS. 5B–5D is a side view of multiple drive subs.
Figure 5C:
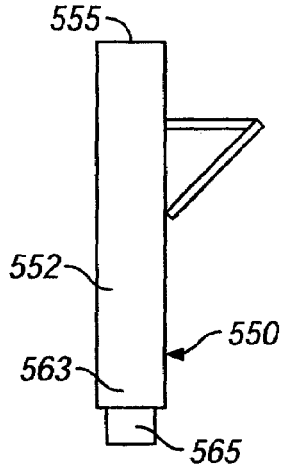
Figure 5D:
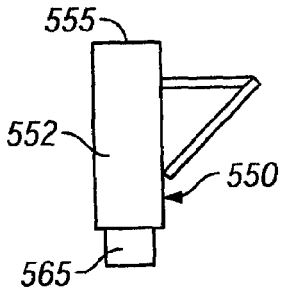

In this embodiment of the present invention, the apparatus further includes tools to assist in the driving of pier sections. As shown in FIGS. 5B–5D, one tool includes a plurality of stackable drive subs (550) which vary in size as shown length as shown in FIGS. 5B–5D. Each drive subs are utilized to assist in pressing the pier sections underneath the ground surface. The drive sub (550) further includes a hollow elongated cylindrical pipe member (552). Pipe member (552) is further defined by upper end (555) and bottom end (563). The bottom end (563) of the drive sub (550) is adapted with a short hollow cylindrical receiver (565) having a slightly smaller circumference than the bottom end (563). The receiver (565) has a slightly smaller circumference to allow the drive sub to stack upon the upper end of a pier section to be driven underneath ground level. The upper end (555) is adapted to receive a receiver (565) of the bottom end (563) of another drive sub or the receiver of the drive head described below. Drive sub (550) further includes an open triangular wedge mounted upon the exterior surface of the pipe member (552) near its proximal end. The triangular wedge is a handle for lifting and mounting the receiver (565) onto a pier section to be driven underground.

Figure 5E:
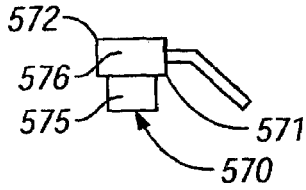
FIG. 5E is a side view of the drive head.

As shown in FIG. 5E, the present invention includes another tool to assist in driving pier sections underground, a drive head (570). The drive head (570) is further defined by a cap member (576) a bottom portion (571) and an upper portion (572). The bottom portion (571) of the drive head (570) is adapted with a short cylindrical receiver (575) having a slightly smaller circumference than the bottom end of a pier section or a drive sub as described above. Receiver (575) has a slightly smaller circumference to allow the drive head (570) to stack upon the upper end of a pier section or a drive sub described above. The cap member (576) has the same diameter as the upper end of a pier section. In use, the drive head is first mounted upon a pier section or a drive sub. Then, the drive cylinder applies pressure directly to the top portion (572) of the cap member (576) as the pier section is driven underground.

Referring to FIG. 7, there is shown an exploded view of lifting mechanism (700). In the illustrated embodiment, the device further includes a lifting mechanism (700) for lifting the foundation after all the desired foundation pier assemblies have been pressed. A pressed pier assembly includes at least one pier section slidably engaged with the foundation shoe. The pier sections are pressed underground until a point of resistance is reached and then the pressed pier section (450) is securely held in place within the foundation shoe (410) with a pier cap (470).

At pre-determined locations, multiple pier assemblies are pressed around the foundation to support the lifting of the foundation to a particular elevation. After each pressed pier assembly (450) is secured with a pier cap (470), the lifting mechanism (700) is operatively attached to each pier assembly. The lifting mechanism (700) can simultaneously handle the lifting of multiple pier assemblies.

In the illustrated embodiment, lifting mechanism (700) further includes a lifting assembly (710) securely attached to the foundation shoe (410) through all threaded studs (760, 761). In the illustrated embodiment, the lifting assembly (710) further includes a hydraulic lifting cylinder (730) sandwiched between two long all threaded studs (760, 761). Each all threaded stud (760, 761) is respectively bolted to upper plate member (740) through apertures located on each opposite end of upper plate member (740). To securely fasten the lifting cylinder (730) to the foundation shoe, the lower end of each threaded nut (760, 761) is securely bolted to each corresponding all threaded stud (722,723) extending above the orifices in pier cap (470)

The lifting mechanism further includes the lifting cylinder (730) being connected to manifold (750) via hydraulic hoses (755). The manifold (750) is then operatively connected to a hydraulic power source, which can be a 10000-PSI hydraulic power source. The manifold can be hydraulically connected to multiple lifting cylinders at once allowing multiple pressed pier assemblies to be lifted.

The apparatus of the present invention is adapted to be easily transported and stored. In this embodiment of the present invention, as shown in FIG. 3, the shaft (183) of the steering mechanism (185) is pivoted upward for storage. The second support frame (510) supporting the seat assembly (520) is pivoted upward for storage. The leg member (240) of the outrigger stabilizer (shown in FIG. 4) can be pivoted into a laterally position for storage. This embodiment further includes a means for storing the drive stand (310). The lower end (346) drive stand (310) is coupled upward to horizontal arm (150) of the crane assembly and the lifting mechanism (175).

OPERATIONAL PROCESS

First, a hole is excavated below the foundation grade beam at each desired pier location. The excavated hole can be at least 14 inches wide by 12 inches deep out from the grade beam and at least 10 inches back under the grade beam. The buggy device is steered near the building foundation. In order to place the drive stand above the hole, the vertical arm of the crane assembly is swiveled to align the drive stand with the hole, next the horizontal arm of the crane assembly is raised up to the desired height, the horizontal arm of the crane assembly is then extended until the drive stand is hanging above the hole and finally, the foundation shoe is bolted to the bottom of the drive stand. By lowering the drive stand with vertical arm of the crane assembly, the foundation shoe is lowered into the hole. After foundation shoe is lowered into the hole, the horizontal plane of the shoe is placed underneath the foundation grade beam. Then, the first pier section is engaged into the foundation shoe and a drive head is placed on the top of the first pier section Utilizing the power source hydraulically connected to the cylinder mounted on the top of the drive stand, the pier is hydraulically pressed underground.

To assist in the pressing of the piers, long and short drive sub are utilized. After the first pier section is pressed a full cylinder stroke, a drive sub is mounted upon the first pier section and is pressed a full cylinder stroke. The short drive sub is removed and a long drive sub is mounted upon the first pier section and pressed a full cylinder stroke. Then, the short drive sub is mounted upon the long drive sub and pressed a full cylinder stroke. Next, both the short and long drive sub are removed. If necessary to meet a point of resistance, an additional pier section is stacked and is pressed a full cylinder stroke. With this embodiment of the present invention, multiple pier sections are pressed into a single excavated hole using the described above process until a point of resistance is met below ground level. When the pier pressing process of a single excavated hole is complete, the piers are secured in place to the foundation shoe with a pier cap. Then, the entire process described above is repeated for the next excavated hole.

After the pier pressing process is completed for each excavated hole, the foundation is ready to be lifted to the desired elevation. A lifting assembly is securely attached to each desired pier assembly. Each lifting assembly is connected to a manifold utilizing a hydraulic hose. The manifold is connected a 10,000 PSI hydraulic power source that provides the power for the lifting process. Additionally, multiple lifting assemblies can be lifted simultaneously via multiple hydraulic hose connections to the manifold.

To elevate the foundation, the lifting cylinder applies additional force unto the pressed pier section through the power source. Since the pressed pier section has reached the point of resistance under ground, the applied force causes the foundation shoe to lift the section of the foundation under which the horizontal flange of the foundation shoe is placed. If multiple lifting assemblies are attached to the manifold, several sections of the foundation can be lifted simultaneously.

What is claimed is:

1. A apparatus for repairing a foundation of a building comprising: a buggy device comprising: a base frame being defined by a front end and a rear end, each end being supported by wheel means; a plate member being transversely mounted upon the base frame proximately near the rear end; a fifth wheel assembly being situated underneath the base frame and being swivelly connected to the wheel means supporting the rear end; a steering mechanism being connected to the fifth wheel assembly for maneuvering the direction of the wheel means supporting the rear end; a crane assembly being supported by the plate member, the crane assembly further comprising: a three hundred sixty degree swivel joint mounted upon the plate member, a vertically extending shaft being swivelly connected to the swivel joint, horizontally extending arm being mounted on the top of the shaft, and a first lifting mechanism being operably connected to the arm such that it can be lowered and raised; a drive stand being swivelly connected to the arm at its far end, the drive stand being adapted to contain a foundation pier assembly to be installed underneath the foundation; a removable hydraulic driving mechanism being mounted upon the upper end of the drive stand for driving the foundation pier assembly into the ground underneath the foundation; at least one outrigger means for stabilizing the weight of the base frame during the pier pressing process, the at least one stabilizer being removably attached to a corner of the base frame; and fifth wheel assembly further comprises: a steering rod extending the width of the rear end and being swivelly connected to the underside of the rear end; and the steering rod being coupled to the rear end means, whereby the apparatus can be maneuvered from one location to another location.

2. The apparatus of claim 1 wherein the base frame further comprises: a polygonal shape rigid planar platform having each side edge re-enforced with a support beam wherein a tray structure is form to support construction equipment; the front end and the rear end each being re-enforced with the support beam with each support beam having an internal cavity at each corner for receiving the at least one outrigger means.

3. The apparatus of claim 2 wherein the outrigger means further comprises: a horizontal beam being defined by a first end and an opposite end; the first end being adapted to be slideably engaged within the internal cavity at each corner of the base frame; a vertical bar member being perpendicularly attached to the opposite end of the horizontal beam and extending linearly downward; the vertical bar member being coupled to a leg member supported by at least one wheel means; and a crankshaft member mounted atop the leg member for securing the leg member at a predetermined location near the building such that the buggy device can be stabilized during the pier pressing process.

4. The apparatus of claim 3 wherein the leg member can be pivoted into a laterally position for storage.

5. The apparatus of claim 1 wherein the steering mechanism further comprises: a shaft connected to the steering rod at its lower end; and a handle being securely attached to the shaft at its upper end.

6. The apparatus of claim 5 wherein the shaft can be pivoted upward for storage.

7. The apparatus of claim 1 wherein the arm further comprises: a first portion being telescoped within a second portion such that the arm can vary in length; and a locking mechanism for securing the arm at a particular length.

8. The apparatus of claim 1 wherein the driving mechanism further comprises: a removable drive cylinder being mounted at the upper end of the drive stand; and a detachable hydraulic power source operatively connected to the drive cylinder, whereby a sustained amount of hydraulic force is generated to drive the foundation pier assembly underneath ground level to a point of resistance.

9. The apparatus of claim 1 wherein the first lifting mechanism is a hydraulic jack.

10. The apparatus of claim 1 wherein the foundation pier assembly further comprises: at least one pier section having an elongated pipe member being defined by an upper end and a bottom end; and the upper end of one pipe member adapted to engage the bottom end of the pipe member of another pier section, wherein multiple pier sections can be stacked upon each other and the stacked pier sections can be driven underneath ground level until a point of resistance is reached.

11. The apparatus of claim 10 wherein the foundation pier assembly further comprises: a foundation shoe having a multi-compartment sleeve on one side and an integrated triangular flange on the opposite side; the upper end of the triangular flange being a planar horizontal upper surface adapted to securely mount underneath the foundation when the at least one pier section is driven underneath ground level; a means for securely fastening the foundation shoe to the lower end of the drive stand; at least one of the multi-compartment sleeve having a diameter to slidably engage the at least one pier section; and a pier cap adapted to securely fasten to the multi-compartment sleeve of the foundation shoe such that the at least one driven pier section can be held in place to support the foundation.

12. The apparatus of claim 11 wherein the multi-compartment sleeve fit comprises: a center sleeve sandwiched between two smaller sleeves; the center sleeve having a diameter dimensioned to slidably engage the at least one pier section; and the pier cap adapted to securely fasten to the smaller sleeves such that the at least one driven pier section can be securely held in place.

13. The apparatus of claim 12 wherein the pier cap further comprises: a plate retaining member having orifices on its opposite sides; and the orifices being aligned over the smaller sleeves of the foundation shoe and being securely coupled to the smaller sleeves of the foundation shoe therethrough such that the driven pier sections can be held in place.

14. The apparatus of claim 11 further comprising a lifting mechanism being securely coupled to a driven pier assembly and being in operative communication with a hydraulic power source such that the foundation can be elevated.

15. The apparatus of claim 14 wherein the lifting mechanism further comprises: a lifting cylinder securely coupled to the foundation shoe of the driven pier assembly; and the lifting cylinder being connected to a manifold in operative communication with a hydraulic power source.

16. The apparatus of claim 15 further comprising a plurality of pier assemblies situated underneath the foundation.

17. The apparatus of claim 16 wherein the manifold is connected to a plurality of lifting mechanisms wherein each lifting mechanism is securely coupled to each foundation shoe to be lifted.

18. The apparatus of claim 11 wherein the tool assembly further comprises: a drive head having a cap portion with an upper surface and an under side; a receiver attached to the underside of the cap portion and adapted to engage the upper end of the pier section; and the upper surface of the cap portion adapted to accommodate the hydraulic drive mechanism during actuation.

19. The apparatus of claim 18 further comprising: at least one drive sub having an elongated pipe member being defined by an upper end and a bottom end, the upper end of the pipe member of the drive sub adapted to engage the receiver of the drive head, the bottom end of the pipe member of the drive sub adapted to engage the upper end of the pipe member of a pier section or the upper end of the pipe member of another drive sub; and a triangular handle being mounted proximately near the upper end of the pipe member for lowering and lifting the drive sub during the pier pressing process.

20. The apparatus of claim 11 wherein the drive stand further comprises: a hollow rectangular housing being tapered at its distal end; and the housing having an central opening extending from its upper end to its lower end; and a sleeve plate retaining member integrated into the bottom of the housing and adapted to securely fastened to the foundation shoe during the pier pressing process.

21. The apparatus of claim 20 further comprising: the sleeve plate retaining member including a larger aperture sandwiched between two smaller apertures; the sleeve plate retaining member adapted to aligned over the multi-compartment sleeve of the foundation shoe wherein each smaller aperture aligns over each smaller sleeve of the foundation shoe such the foundation shoe can be coupled to the drive stand therethrough.

22. The apparatus of claim 1 wherein the wheel means are large pneumatic tires.

23. The apparatus of claim 1 further comprising a seat assembly swivelly mounted upon a horizontal support member, which is connected to the rear end of the base frame.

24. The apparatus of claim 23 wherein the horizontal support member can be pivoted upward when the device is non-operational.

25. The apparatus of claim 1 further comprising a means for storing the drive stand during non-operational use.

26. An apparatus for repairing a sunken foundation of a building comprising: a base frame being defined by a front end and a rear end, each end being supported by wheel means; a plate member being transversely mounted upon the base frame proximately near the rear end; a crane assembly being supported by the plate member, the crane assembly further comprising: a three hundred sixty degree swivel joint mounted upon the plate member; a vertically extending shaft being swivelly connected to the swivel joint, a horizontally extending arm being mounted on the top of the shaft, and a lifting mechanism connected to the arm such that it can be lowered and raised; a fifth wheel assembly being situated underneath the base frame and being pivotally connected to the wheel means supporting the rear end; a steering mechanism being connected to the fifth wheel assembly for maneuvering the direction of the rear wheel means; and fifth wheel assembly further comprises: a steering rod extending the width of the rear end and being swivelly connected to the underside of the rear end; and the steering rod being coupled to the rear end means, whereby the apparatus can be maneuvered from one location to another location; a drive stand being swivelly connected to the arm at its far end, the drive stand being adapted to contain a foundation pier assembly; a drive cylinder removably mounted upon the drive stand at its upper end; a hydraulic power source operatively connected to the drive cylinder for driving the foundation pier assembly underneath the foundation to a point of resistance; at least one outrigger for stabilizing the weight of the base frame during pier driving process, the at least one stabilizer being removably attached to a corner of the base frame; a seat assembly swivelly mounted upon a horizontal support member which is connected to the rear side of the base frame; a hydraulic lifting mechanism operatively coupled to the driven foundation pier assembly such that sunken foundation can be elevated to a particular height; and a means for storing the apparatus while not in operational use.

27. A method of repairing the sunken foundation of a building: a) providing an apparatus with a buggy device having a crane assembly mounted thereupon, the crane assembly having a vertical arm and a horizontal arm, a pier assembly having at least one pier section and a foundation shoe with a horizontal plane at its upper end, a drive stand mounted upon the far end of the horizontal arm of the crane assembly, a drive cylinder mounted upon the top of the drive stand, a long and short drive subs to assist driving the pier sections; b) excavating a hole underneath the grade beam of the foundation of a building for each desired pier assembly location; c) maneuvering the buggy device near the first hole; d) swiveling the vertical arm of the crane assembly such that the drive stand is aligned with the excavated hole; e) bolting the foundation shoe to the bottom of the drive stand; f) raising the horizontal arm of the crane assembly to a predetermined height; g) extending the horizontal arm of the crane assembly such that the drive stand is positioned over the hole; h) lowering the horizontal arm of the crane assembly until the foundation shoe is in the hole; i) placing the horizontal plane of the foundation shoe underneath the foundation; j) mounting the drive cylinder upon the upper end of the drive stand; k) slidably engaging at least one pier section within the foundation shoe; l) hydraulically pressing the at least one pier section under ground until a point of resistance is reach; m) unbolting the drive stand from the foundation shoe; n) securing the at least one pressed pier section to the foundation shoe; o) repeating steps (b–m) until each excavated hole has a driven pier assembly; p) hydraulically lifting each driven pier assembly until the sunken foundation is elevated to a desired point.

28. The method of claim 27 wherein the pressing the at least one pier section further comprises: a) hydraulically pressing the pier section one full cylinder stroke; b) mounting a short drive sub on top the pier section; c) hydraulically pressing the short drive sub one full cylinder stroke; d) removing the short drive sub; e) mounting a long drive sub on top the pier section; f) hydraulically pressing the long drive sub one full cylinder stroke; g) mounting a short drive sub on top the long drive sub; h) hydraulically pressing the short and long drive sub one full cylinder stroke; i) removing the short drive sub; j) removing the long drive sub; k) slidably engaging an additional pier section upon the previously pressed pier section; and l) repeating steps (a–k) until multiple pier sections are pressed to a point of resistance.

29. The method of claim 27 further comprises simultaneously hydraulically lifting multiple pressed pier assemblies.

* * * * *